US007086105B1

(12) United States Patent
Gottlieb

(10) Patent No.: US 7,086,105 B1
(45) Date of Patent: Aug. 8, 2006

(54) PILLOW TRAPEZE

(76) Inventor: Nathan Gottlieb, 4470 Rue Demers, Orchard Lake, MI (US) 48323

( * ) Notice: Subject to any disclaimer, the term of this patent is extended or adjusted under 35 U.S.C. 154(b) by 0 days.

(21) Appl. No.: 10/771,759

(22) Filed: Feb. 4, 2004

(51) Int. Cl.
*A47C 1/10* (2006.01)

(52) U.S. Cl. ..... 5/658; 5/492

(58) Field of Classification Search ..... 5/492–498, 5/504.1, 658; 24/115 G, 136 R, 122.6
See application file for complete search history.

(56) References Cited

U.S. PATENT DOCUMENTS

| | | | | |
|---|---|---|---|---|
| 3,346,892 | A | 10/1967 | Du Priest | 5/325 |
| 3,506,988 | A | 4/1970 | Saddoris | 5/325 |
| 5,503,456 | A | 4/1996 | Rossini | 297/397 |
| 6,030,085 | A * | 2/2000 | Leam et al. | 359/871 |
| 6,126,237 | A * | 10/2000 | Ritterhouse | 297/397 |
| 6,438,805 | B1 | 8/2002 | Goss et al. | 24/302 |
| 6,666,426 | B1 * | 12/2003 | Taylor | 248/506 |
| 6,807,696 | B1 * | 10/2004 | Magistretti | 5/633 |
| 2003/0009859 | A1 | 1/2003 | Goss et al. | 24/302 |

* cited by examiner

*Primary Examiner*—Thomas B. Will
*Assistant Examiner*—Fredrick Conley
(74) *Attorney, Agent, or Firm*—Young & Basile, P.C.

(57) ABSTRACT

An apparatus and method for limiting movement of a pillow relative to a bed. At one end, flexible member can be engaged with a pillow. At the other end of the flexible member, a weight can be suspended from an edge of the bed. The invention can include a clip engageable with the pillow to releasibly associate the member and the pillow. The weight can be moveably associated with respect to the member to selectively space the weight and the member with respect to one another.

4 Claims, 2 Drawing Sheets

PILLOW TRAPEZE

FIELD OF THE INVENTION

The invention relates to an apparatus for limiting movement of a pillow relative to a bed.

BACKGROUND OF THE INVENTION

A bed can include a head portion and a foot portion wherein the head portion is moveable relative to the foot portion. In particular, the head portion of the bed can be raised to support an occupier of the bed in an inclined position. A pillow can be positioned between the occupier of the bed and the head portion of the bed. If the head portion of the bed is raised and the occupier of the bed inclines further with respect to the head portion, the pillow can move relative to the bed. For example, a hospital patient resting in bed, in an inclined position, may sit-up to receive medication. When sitting up, the patient's pillow can slide down the head portion. A nurse or visitor may have to hold the pillow in a desired position as the patient reclines after sitting up.

SUMMARY OF THE INVENTION

The present invention provides an apparatus and method for limiting movement of a pillow relative to a bed. The invention includes at least one flexible such as string or cord that can engage a pillow. The invention also includes at least one weight suspended from the edge of the bed with the flexible member.

The flexible member can be releasibly engageable with the pillow. For example, a clip can be connected to one end of the flexible member to engage the pillow. The flexible member can be a hollow, plastic tube. The invention can include a plurality of flexible members concurrently engageable with the pillow and with the at least one weight. The flexible member can be movable relative to the weight. The invention can include means for limiting movement of the flexible member relative to the weight.

The weight can include a channel and the flexible member can be received in the channel. The invention can include a cap for closing the channel. The weight can include a retaining pin engageable with the caps to limit movement of the cap relative to the weight.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
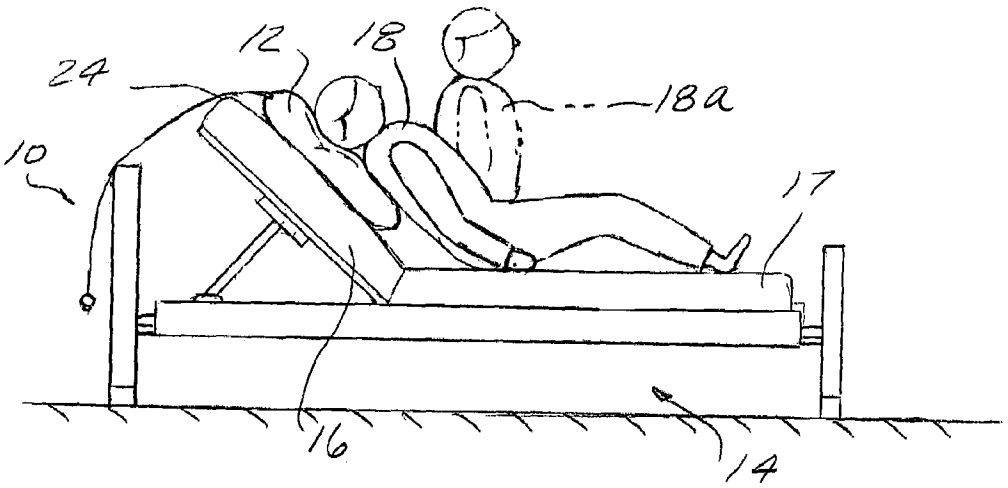
FIG. 1 is a side view of the apparatus according to the present invention maintaining the position of a pillow relative to a bed.

Referring now to FIG. 1, the present invention provides an apparatus 10 for limiting movement of a pillow 12 relative to a bed 14. The bed 14 can include a head portion 16 and a foot portion 17. The bed 14 can be a hospital bed. An individual or patient 18 can be supported by the bed 14. The pillow 12 can be positioned between the patient 18 and the head portion 16. At various times, the patient 18 can further incline, such as by moving to a sitting-up position 18*a*, and disengage with respect to the pillow 12. When the patient is in the sitting position 18*a*, the pillow 12 can move towards the foot portion 17 due to gravity. The apparatus 10 can be releasibly engageable with respect to the pillow 12 to limit movement of the pillow 12 relative to the bed 14.

Figure 2:
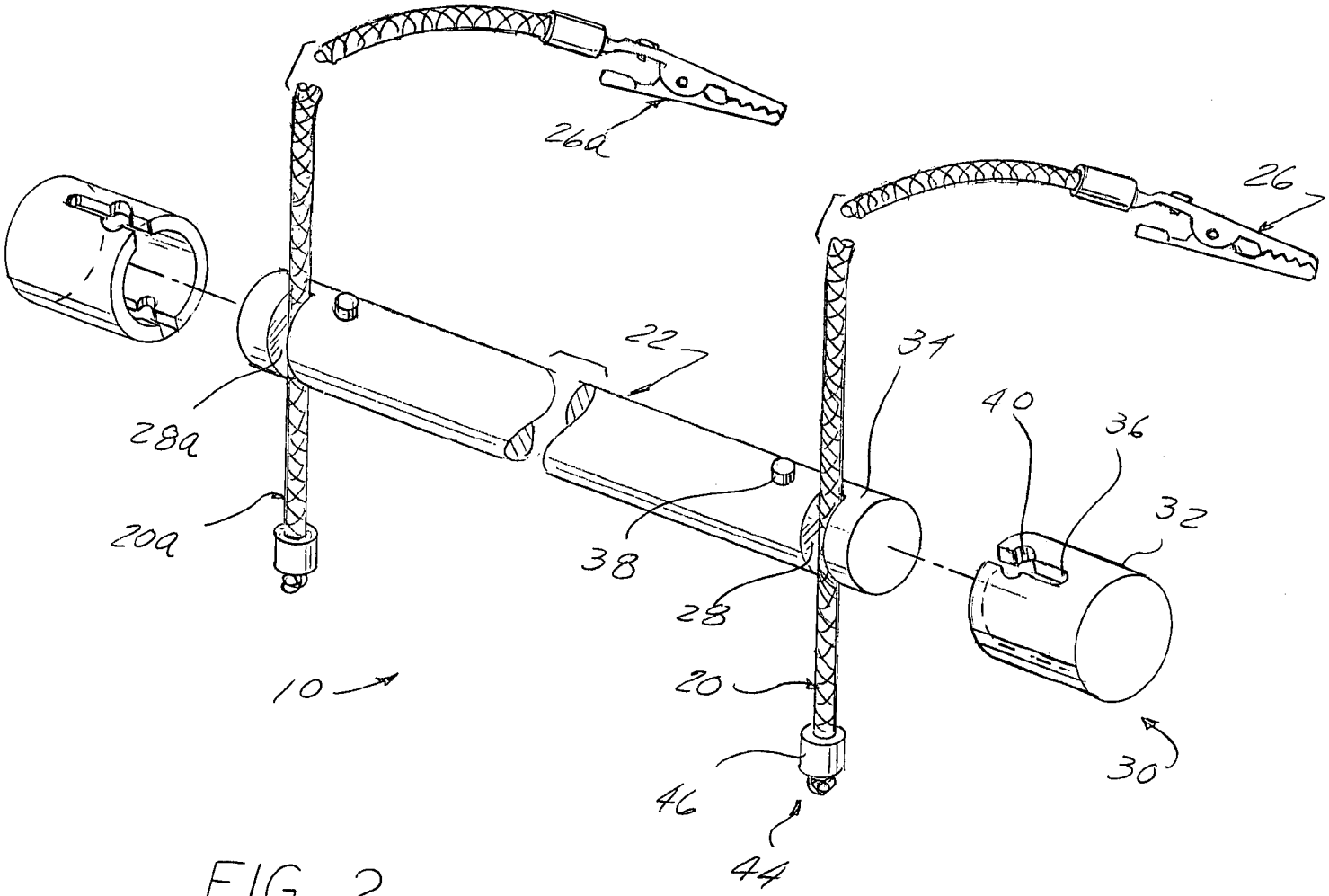
FIG. 2 is a perspective view of the apparatus according to the present invention.

Referring now to FIG. 2, the apparatus 10 includes at least one flexible member 20 engageable with the pillow 12 (shown in FIG. 1) and at least one weight 22 operable to be suspended from an edge 24 (shown in FIG. 1) of the bed 14 with the at least flexible member 20. The at least one flexible member can be a string, a chain, or a hollow or solid plastic elongated member. For example, the flexible member 20 can be a plastic tube. The apparatus 10 can include a plurality of flexible members 20, 20*a*, each flexible member 20, 20*a* engageable with respect to the pillow 12 (shown in FIG. 1).

Each of the flexible members 20, 20*a* can be releasibly engageable with respect to the pillow. For example, the apparatus 10 can include one or more clips 26 engageable with respect to the at least one flexible member 20. The clip 26 can releasibly associate the at least one flexible member 20 with respect to the pillow 12. Clips 26, 26*a* can be individually engageable with respect to flexible members 20, 20*a* to releasably engage the flexible members 20, 20*a* with respect to the pillow 12. Alternatively, a plurality of clips can be engageable with respect to one flexible member.

The at least one weight 22 is sized to prevent movement of the pillow 12 relative to the bed 14 (shown in FIG. 1). For example, where movement of a relatively heavier pillow is to be limited, the weight 22 should be heavier than when movement of a relatively lighter pillow is to be limited. The weight 22 can be shaped as a shaft. The weight 22 can be hollow or solid. The weight 22 can be plastic, wood or metallic.

Figure 3:
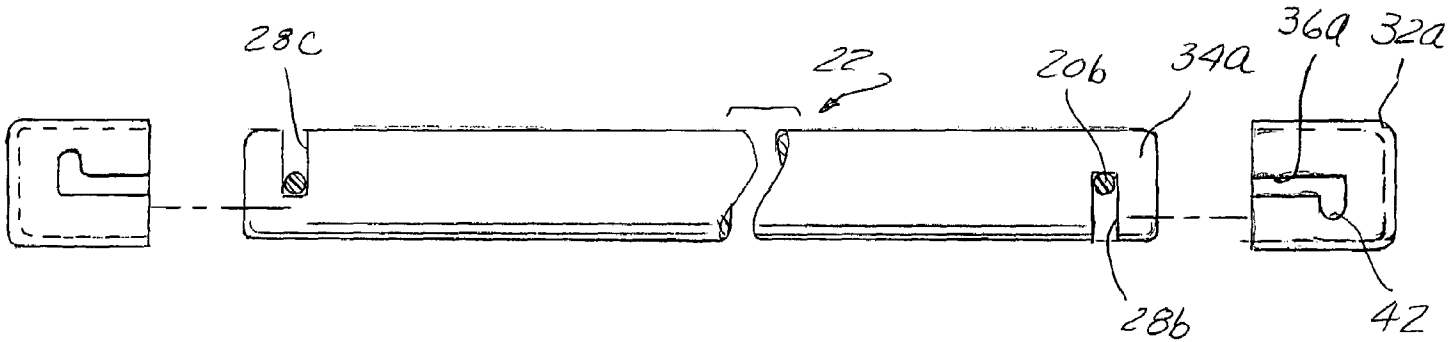
FIG. 3 is an exploded view of an alternative embodiment of the present invention.

The at least one weight 22 is engaged with respect to the at least one flexible member 20 to be suspended from the edge 24 (shown in FIG. 1) of the bed 14 (shown in FIG. 1). The flexible member 20 and weight 22 can be moveably associated with respect to one another. For example, the weight 22 can define a notch or channel 28 operable to receive the at least one flexible member 20. In an embodiment of the invention including a plurality of flexible members, the weight 22 can define a plurality of channels 28, 28*a*. As shown in FIG. 3, a weight 22*a* can include a plurality of channels 28*b*, 28*c* wherein the channels 28*b*, 28*c* are open in opposite directions with respect to one another.

The apparatus 10 can also include means 30 for limiting movement of the flexible member 20 transverse with respect to the channel 28. Means 30 can include a cap 32 engageable with respect to an end 34 of the weight 22. The cap 32 can be slidably received over the end 34 and substantially cover the channel 28. The cap 32 can include a notch 36 for receiving the flexible member 20. The flexible member 20 can move axially relative to the cap 32 and to the channel 28. The weight 22 can include a retaining pin 38 and the notch 36 can include a receiving portion 40. The pin 38 and receiving portion 40 are engageable with respect to one another when the cap 32 is slidably received with respect to the end 34. Cooperation between the retaining pin 38 and the receiving portion 40 can substantially prevent movement of the cap 32 with respect to the end 34.

In FIG. 3, a cap 32*a* can be slidably received with respect to an end 34*a* of the weight 32*a*. The cap 32*a* can be rotated relative to the weight 22*a* and the flexible member 20*b* can be received in a receiving portion 42 of a notch 36*a*.

The apparatus 10 can also include means 44 for limiting movement of the at least one member 20 relative to the weight 22, movement that is axial with respect to the member 20 and transverse with respect to a longitudinal axis of the weight 22. Means 44 can include a stop 46. Stop 46 can be moveable with respect to the member 20 to selectively space the weight 22 and the pillow 12 with respect to one another. The stop 46 can be rubber or plastic. In operation, the weight 22 can be supported by the stop 46.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for limiting movement of a pillow relative to a bed comprising:

first and second clips engagable with the pillow;

first and second flexible members engagable with respect to the first and second clips respectively;

at least one weight defining a shaft suspended from an edge of the bed via the first and second flexible members wherein the shaft further comprises first and second channels wherein the first and second flexible members are individually positionable in the first and second channels, respectively; and wherein the apparatus further comprising first and second end caps individually positionable with respect to ends of the shaft to enclose the first and second channels, respectively, first and second retaining pins individually engagable with the first and second end caps, respectively, to limit movement of the first and second end caps relative to the shaft.

2. The apparatus of claim 1 further comprising:

first and second stops individually engagable with the first and second flexible members, respectively, to selectively space the shaft with respect to the pillow.

3. The apparatus of claim 2 wherein the first and second channels open in opposite directions with respect to one another.

4. The apparatus of claim 2 wherein the first and second channels open in the same direction with respect to one another.

* * * * *